US010414028B2

(12) United States Patent
Tsai

(10) Patent No.: US 10,414,028 B2
(45) Date of Patent: Sep. 17, 2019

(54) RATCHET WRENCH

(71) Applicant: Tsung-Chih Tsai, Taichung (TW)

(72) Inventor: Tsung-Chih Tsai, Taichung (TW)

(73) Assignee: Stanley Chiro International Ltd., Taichung Hsien (TW)

( * ) Notice: Subject to any disclaimer, the term of this patent is extended or adjusted under 35 U.S.C. 154(b) by 101 days.

(21) Appl. No.: 15/496,424

(22) Filed: Apr. 25, 2017

(65) Prior Publication Data

US 2018/0126519 A1 May 10, 2018

(30) Foreign Application Priority Data

Nov. 8, 2016 (TW) ..... 105136259 A

(51) Int. Cl.
*B25B 13/46* (2006.01)

(52) U.S. Cl.
CPC ..... *B25B 13/463* (2013.01)

(58) Field of Classification Search
USPC ..... 81/63.1, 60, 61, 62, 63
See application file for complete search history.

(56) References Cited

U.S. PATENT DOCUMENTS 5,782,147 A * 7/1998 Chaconas ..... B25B 13/463 192/43.1
9,649,751 B2 * 5/2017 Huang ..... B25B 13/463
2005/0257650 A1 * 11/2005 Hu ..... B25B 13/463 81/63.1
2015/0000474 A1 * 1/2015 Wang ..... B25B 13/465 81/63.1
2015/0027276 A1 * 1/2015 He ..... B25B 17/00 81/57.29
2015/0258667 A1 * 9/2015 Wu ..... B25B 13/465 81/62

* cited by examiner

*Primary Examiner* — Joseph J Hail
*Assistant Examiner* — Shantese L McDonald
(74) *Attorney, Agent, or Firm* — Caeden Drayton; Adan Ayala

(57) ABSTRACT

A ratchet wrench includes a main body, a driving assembly, a restricting member, a switching member and an elastic abutting assembly. The main body has a first containing chamber and a second containing chamber which is communicated with the first containing chamber. The restricting member includes a first driving member and a second driving member which are assembled within the first containing chamber. The first driving member and the second driving member are at least partially overlapped with each other, and movable and swingable relatively. The switching member is rotatably assembled within the second containing chamber. The switching member is selectively swingable to a first position or a second position.

9 Claims, 13 Drawing Sheets

RATCHET WRENCH

This patent application claims priority to TW Patent Application No. 105136259, filed Nov. 8, 2016, which is hereby incorporated by reference in its entirety.

I. FIELD OF INVENTION

The present invention relates to hand tools, and more particularly to a ratchet wrench.

II. BACKGROUND OF THE INVENTION

A known ratchet wrench, such as that described in the patent numbered TWI529034, is primarily a wrench body provided with a drive ratchet wheel, a ratchet block and a knob, where the knob is rotatably disposed on the body. A spring is provided between the knob and the ratchet block to normally abut the ratchet block towards the drive ratchet wheel so as to limit the direction of rotation of the drive ratchet wheel. For example, when the knob is toggled to the left, the knob will move the ratchet block to the left, such that the teeth of the ratchet block are engaged with the drive ratchet wheel, and when the drive ratchet wheel is desired to be rotated in the clockwise direction, as the left half of the ratchet block is wedged between the wrench body and the drive ratchet wheel, the drive ratchet wheel is unable to rotate clockwise and instead can only rotate in an anticlockwise direction to achieve an idling effect, and vice versa.

However, the known ratchet wrench harbours the following problem: for example, when the knob is toggled to the left and the drive ratchet wheel is desired to rotate in an anticlockwise direction, if the ratchet block or drive ratchet wheel is manufactured with excessively large dimensional tolerance, the teeth on the right half of the ratchet block become stuck in the drive ratchet wheel so that the drive ratchet wheel cannot be smoothly rotated anticlockwise. This in turn will prevent the knob from being smoothly toggled from left to right, not only impacting on working efficiency, but also damaging the ratchet wrench. However, if the ratchet block or drive wheel is manufactured with reduced dimensional tolerance to avoid this problem, the costs of manufacturing the known ratchet wrench will rise considerably, which is a shortcoming in need of improvement.

Accordingly, there is a need to provide a novel and improved ratchet wrench to solve the above-mentioned problem.

III. SUMMARY OF THE INVENTION

It is a primary object of the present invention to provide a ratchet wrench which allows the drive ratchet wheel to normally idle in one direction and which effectively prevents jerky switching caused by the drive ratchet wheel jamming with the ratchet block while also being simple and inexpensive to manufacture.

To achieve the above object, the present invention provides a ratchet wrench comprising a body, a driving member, a stopping assembly, a switching member and an elastic abutting assembly. The body is provided with a first chamber and a second chamber communicating with the first chamber. The driving member is rotatably disposed within the first chamber and is circumferentially provided with an annular toothed part along an outer peripheral surface. The stopping assembly comprises a first stopping member and a second stopping member which are disposed in the first chamber, are at least partially overlapped with each other, and can slide and swing relative to each other. The first stopping member is provided with a first ratchet part, and a side of the first stopping member opposite the first ratchet part is provided with a first abutment part and a first pressing part, the first abutment part being adjacent to the first ratchet part and the first pressing part being away from the first ratchet part. The second stopping member is provided with a second ratchet part, and a side of the second stopping member opposite the second ratchet part is provided with a second abutment part and a second pressing part, the second abutment part being adjacent to the second ratchet part and the second pressing part being away from the second ratchet part. The switching member is rotatably disposed in the second chamber, is provided with a hole in the radial direction, and is selectively rotated to a first position or a second position. One end of the elastic abutting assembly is received in the hole of the switching member, while the other end abuts against the first stopping member and the second stopping member in a mutually limiting manner, and the first stopping member and the second stopping member abut in the direction of the annular toothed part. Wherein, when the switching member is rotated to said first position, the elastic abutting assembly abuts against the first abutment part so that the first ratchet part abuts against the annular toothed part, and the elastic abutting assembly also abuts against the second pressing part of the second stopping member so as to cause the second ratchet part to move in a direction away from the annular toothed part and not become engaged therewith; when the switching member is rotated to said second position, the elastic abutting assembly abuts against the second abutment part so that the second ratchet part abuts against the annular toothed part, and the elastic abutting assembly also abuts against the first pressing part of the first stopping member so as to cause the first ratchet part to move in a direction away from the annular toothed part and not become engaged therewith.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the root terms "include" and/or "have", when used in this specification, specify the presence of stated features, steps, operations, elements, and/or components, but do not preclude the presence or addition of at least one other feature, step, operation, element, component, and/or groups thereof.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus.

For definitional purposes and as used herein "connected" or "attached" includes physical, whether direct or indirect, affixed or adjustably mounted, as for example, the second arm is keyed or operately connected to a pivot pin having a central axis of rotation. Thus, unless specified, "connected" or "attached" is intended to embrace any operationally functional connection.

As used herein "substantially," "generally," "slightly" and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

In the following description, reference is made to accompanying drawings which are provided for illustration purposes as representative of specific exemplary embodiments in which the invention may be practiced. Given the following description of the specification and drawings, the apparatus and methods should become evident to a person of ordinary skill in the art. Further areas of applicability of the present teachings will become apparent from the description provided herein. It is to be understood that other embodiments can be utilized and that structural changes based on presently known structural and/or functional equivalents can be made without departing from the scope of the invention.

IV. BRIEF DESCRIPTION OF THE DRAWINGS

Similar reference characters denote corresponding features consistently throughout the attached drawings.

V. DESCRIPTION OF EMBODIMENTS

Figure 1:
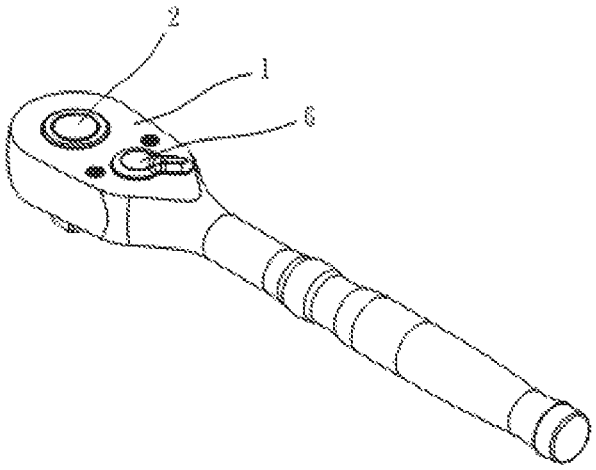
FIG. 1 is a perspective view of a first preferred embodiment of the present invention.
Figure 2:
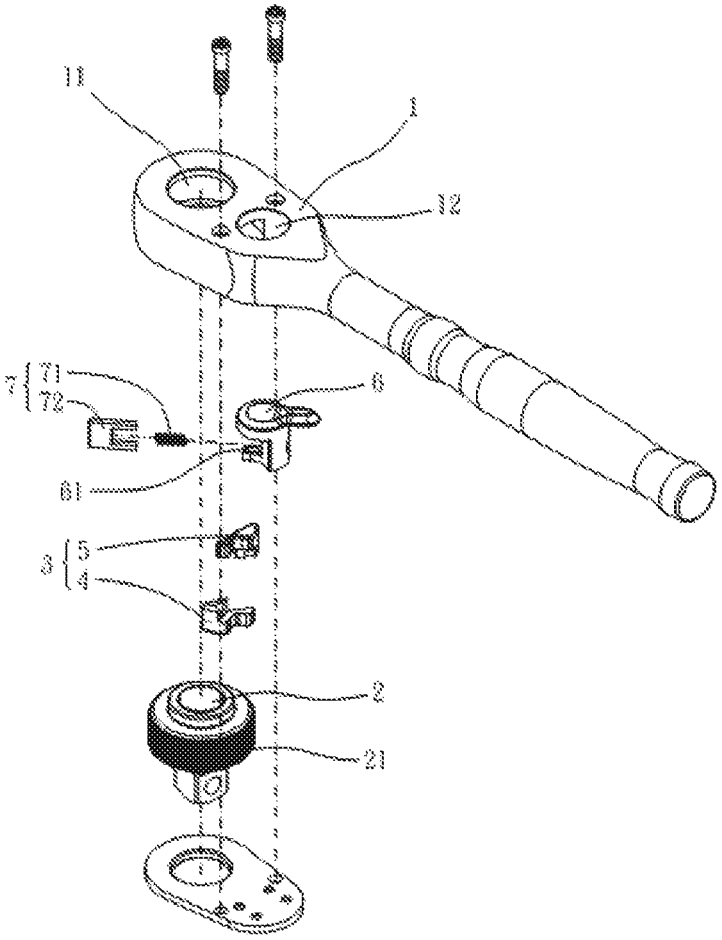
FIG. 2 is an exploded view of a first preferred embodiment of the present invention.
Figure 3:
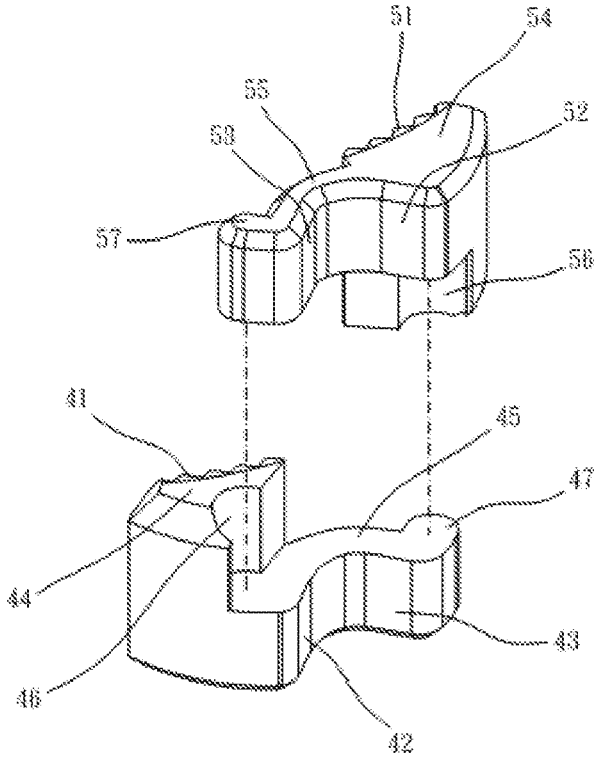
FIG. 3 is a partial enlarged view of a first preferred embodiment of the present invention.
Figure 4:
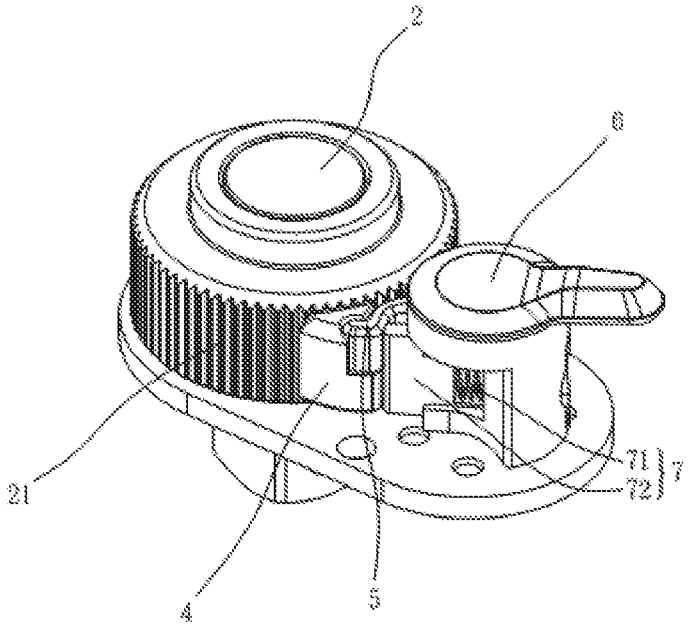
FIG. 4 is a partial assembly view of a first preferred embodiment of the present invention.

With reference now to the drawings, in particular to FIGS. 1-11, thereof, apparatuses embodying features, principles, and concepts of various exemplary embodiments of an adjustable plier will be described.

Referring to FIGS. 1 to 7, which depict a first preferred embodiment of the present invention. The ratchet wrench of the present invention comprises a body 1, a driving member 2, a stopping member 3, a switching member 6, and an elastic abutting assembly 7.

The body 1 is provided with a first chamber 11 and a second chamber 12 communicating with the first chamber 11.

The driving member 2 is rotatably disposed in the first chamber 11 and is circumferentially provided with an annular toothed part 21 along the outer peripheral surface.

The stopping assembly 3 comprises a first stopping member 4 and a second stopping member 5 which are disposed in the first chamber 11, are at least partially overlapped with each other, and can slide and swing relative to each other. The first stopping member 4 is provided with a first ratchet part 41, and a side of the first stopping member 4 opposite the first ratchet part 41 is provided with a first abutment part 42 and a first pressing part 43, the first abutment part 42 being adjacent to the first ratchet part 41 and the first pressing part 43 being away from the first ratchet part 41. The second stopping member 5 is provided with a second ratchet part 51, and a side of the second stopping member 5 opposite the second ratchet part 51 is provided with a second abutment part 52 and a second pressing part 53, the second abutment part 52 being adjacent to the second ratchet part 51 and the second pressing part 53 being away from the second ratchet part 51.

The switching member 6 is rotatably disposed in the second chamber 12, is provided with a hole 61 in the radial direction, and is selectively rotated to a first position or a second position.

One end of the elastic abutting assembly 7 is received in the hole 61 of the switching member 6, while the other end abuts against the first stopping member 4 and the second stopping member 5 in a mutually limiting manner, and the first stopping member 4 and the second stopping member 5 abut in the direction of the annular toothed part 21. Specifically, the elastic abutting assembly 7 in the present embodiment comprises an elastic member 71 and an abutting block 72, the elastic member 71 being elastically urged between the switching member 6 and the abutting block 72 such that the abutting block 72 normally abuts in a direction away from the switching member 6, and the abutting block 72 causes the first stopping member 4 and second stopping member 5 to normally abut against the annular toothed part 21.

Figure 5:
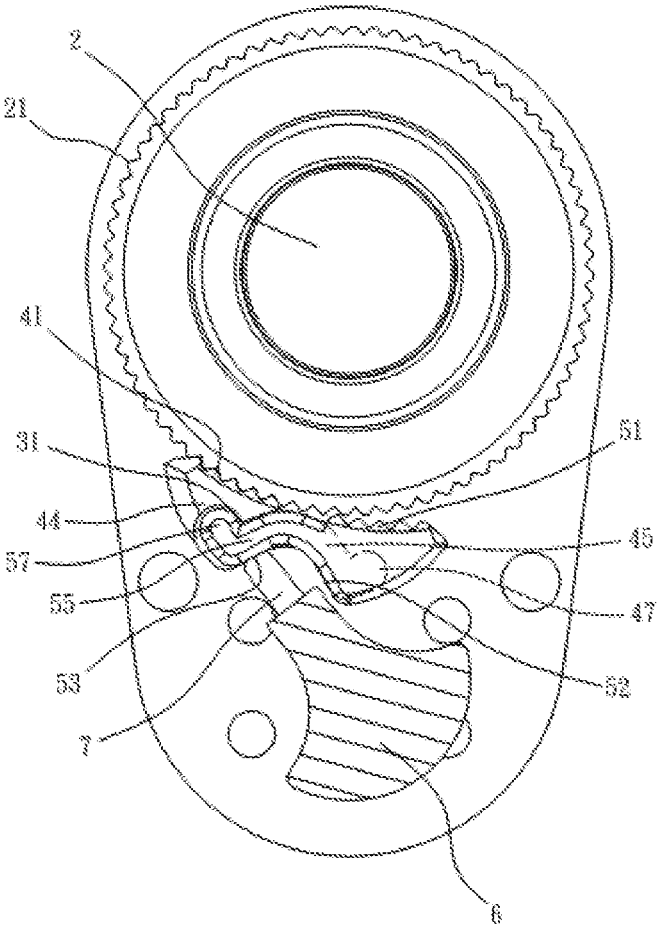
FIG. 5 to FIG. 7 are schematic views of the operation of a first preferred embodiment of the present invention.
Figure 6:
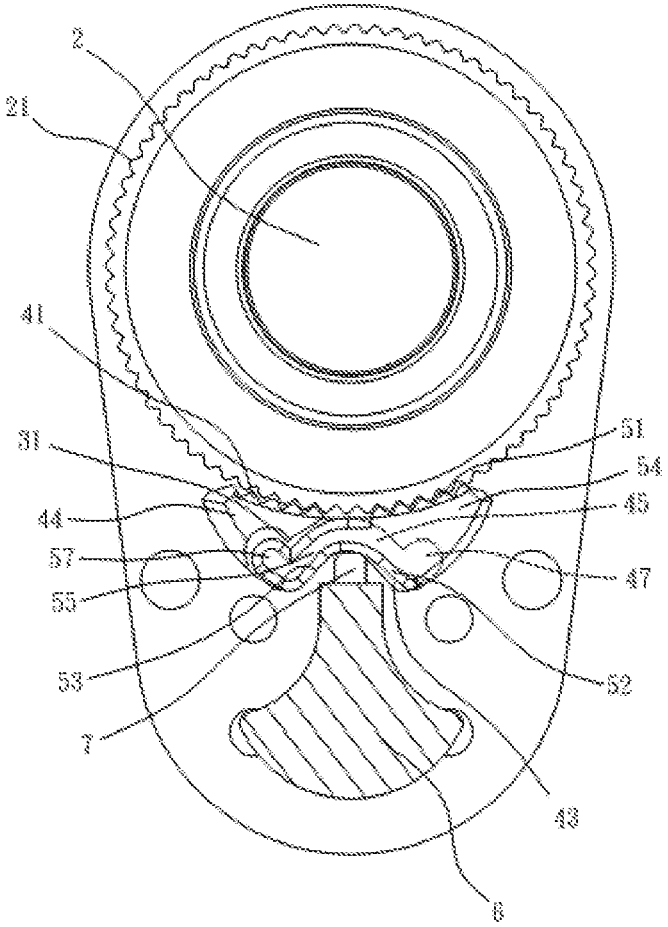
Figure 7:
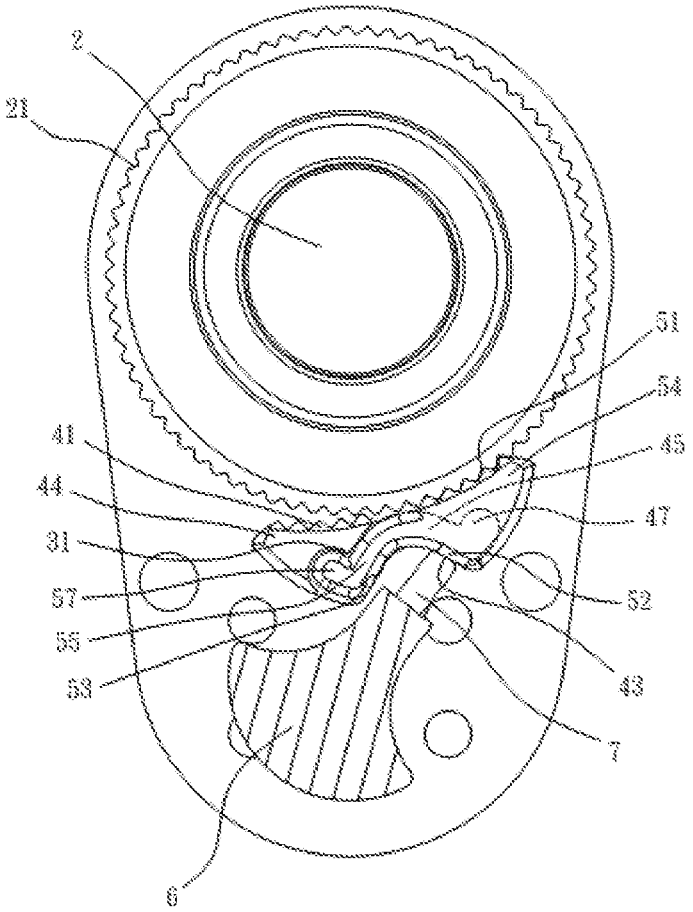

Wherein, also referring to FIG. 5, when the switching member 6 is rotated to said first position, the elastic abutting assembly 7 abuts against the first abutment part 42 so that the first ratchet part 41 abuts against the annular toothed part 21, and the elastic abutting assembly 7 also abuts against the second pressing part 53 of the second stopping member 5 so as to cause the second ratchet part 51 to move in a direction away from the annular toothed part 21 and not become engaged therewith. Specifically, because the second stopping member 5 can slide and swing relative to the first stopping member 4 when the first ratchet part 41 becomes engaged with the annular toothed part 21, the elastic abutting assembly 7 abutting against the second pressing part 53 will cause the second ratchet part 51 to slide and swing in a direction away from the annular toothed part 21, at which point the driving member 2 can only rotate in an anticlockwise direction and not in a clockwise direction. Therefore, the second ratchet part 51 will not interfere with the driving member 2 rotating in this anticlockwise direction, and the driving member 2 is able to smoothly achieve an idling effect. As depicted in FIG. 6 and FIG. 7, when the switching member 6 is rotated from said first position to said second position, the elastic abutting assembly 7 abuts against the second abutment part 52 so that the second ratchet part 51 abuts against the annular toothed part 21, and the elastic abutting assembly 7 also abuts against the first pressing part 43 of the first stopping member 4 so as to cause the first ratchet part 41 to move in a direction away from the annular toothed part 21 and not become engaged therewith. Similarly, because the first stopping member 4 can slide and swing relative to the second stopping member 5, when the second ratchet part 51 becomes engaged with the annular toothed part 21, the elastic abutting assembly 7 abutting against the first pressing part 43 will cause the first ratchet part 41 to slide and swing in a direction away from the annular toothed part 21, at which point the driving member 2 can only rotate in a clockwise direction and not in an anticlockwise direction. Therefore, the first ratchet part 41 will not interfere with the driving member 2 rotating in this clockwise direction, and the driving member 2 can likewise smoothly achieve an idling effect. Consequently, the ratchet wrench of the present invention acts so that the driving member can only engage with either the first ratchet part 41 or the second ratchet part 51 at any one time, thus allowing the driving member 2 to smoothly maintain one-way idling, while also avoiding jamming of the driving member 2 with the first ratchet part 41 or second ratchet part 51 leading to the switching member 6 being unable to smoothly switch positions.

Further, the first stopping member 4 in the present embodiment comprises a first ratchet block 44 and a first pin 45 which are connected to each other, wherein the first ratchet part 41 is disposed on the first ratchet block 44. The second stopping member 5 comprises a second ratchet block 54 and a second pin 55 which are connected to each other, wherein the second ratchet part 51 is disposed on the second ratchet block 54. The first abutment part 42 and the first pressing part 43 are disposed on the first pin 45, and the second abutment part 52 and the second pressing part 53 are disposed on the second pin 55. The first pin 45 and second pin 55 overlap each other, the first abutment part 42 corresponds to the second pressing part 53 and the first pressing part 43 corresponds to the second abutment part 52. Wherein, the thickness of the first pin 45 and second pin 55 in the present embodiment is equal to one half of the first ratchet block 44, and the thickness of the second ratchet block 54 is the same as that of the first ratchet block 44, so that the centre of gravity of the first stopping member 4 is balanced when engaged with second stopping member 5.

Preferably, a gap 31 is formed between the first pin 45 and the second ratchet block 54, and another gap 31 is formed between the second pin 55 and the first ratchet block 44, said gaps 31 allowing sufficient space between the first stopping member 4 and the second stopping member 5 for them to slide and swing relative to each other.

It is worth mentioning that in this embodiment the first ratchet block 44 forms a first groove 46, and the second ratchet block 54 forms a second groove 56, wherein the first groove 46 and second groove 56 are arcuate grooves. The ends of the first pin 45 and the second pin 55 respectively form a first bent end 47 and a second bent end 57, said first bent end 47 being accommodated in the second groove 56, and said second bent end 57 being accommodated in the first groove 46. The shapes of the first bent end 47 and the second bent end 57 correspond to the shapes of the second groove 56 and the first groove 46, such that the first stopping member 4 and the second stopping member 5 are swung against each other without interfering with each other. Specifically, because the elastic abutting assembly 7 simultaneously abuts against both the first stopping member 4 and the second stopping member 5, the first bent end 47 is slightly hooked on the wall of the second groove 56, and the second bent end 57 is similarly hooked on the wall of the first groove 46, such that the first stopping member 4 will not detach from the second stopping member 5, and when the switching member 6 rotates, the first stopping member 4 and the second stopping member 5 move smoothly together.

Figure 8:
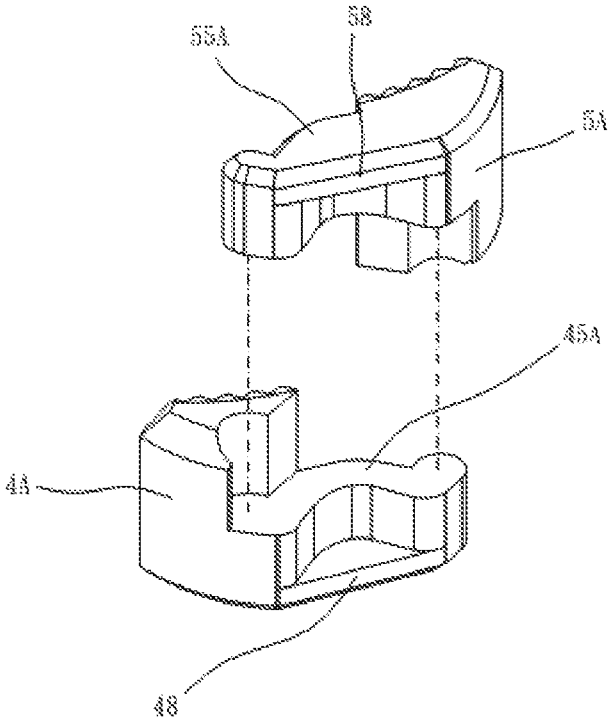
FIG. 8 is a partial enlarged view of a second preferred embodiment of the present invention.
Figure 9:
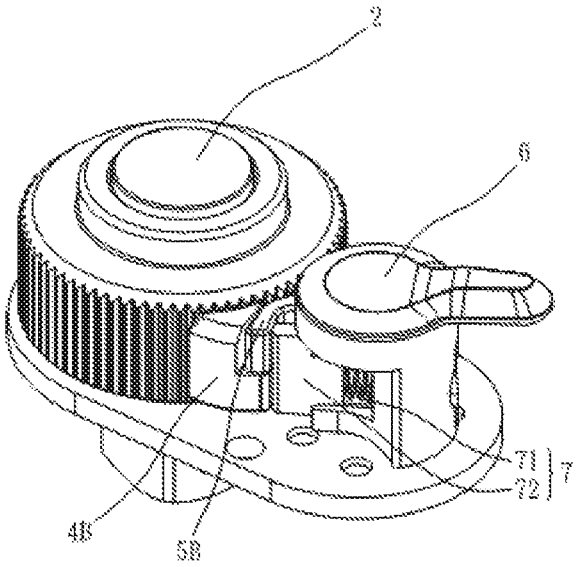
FIG. 9 is a partial assembly view of a third preferred embodiment of the present invention.
Figure 10:
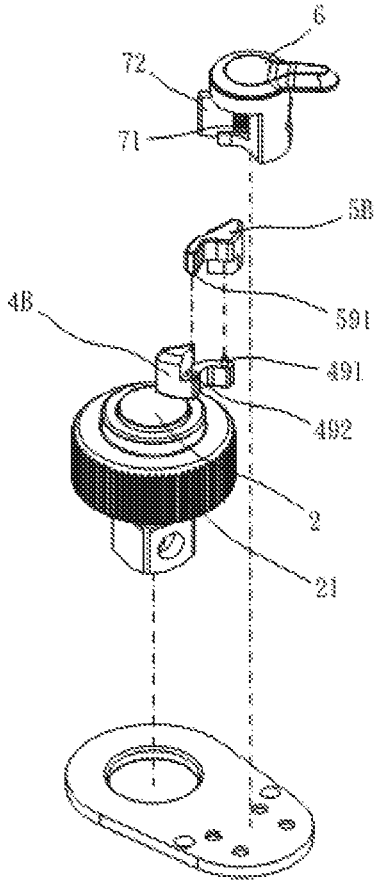
FIG. 10 is a partial exploded view of a third preferred embodiment of the present invention.
Figure 11:
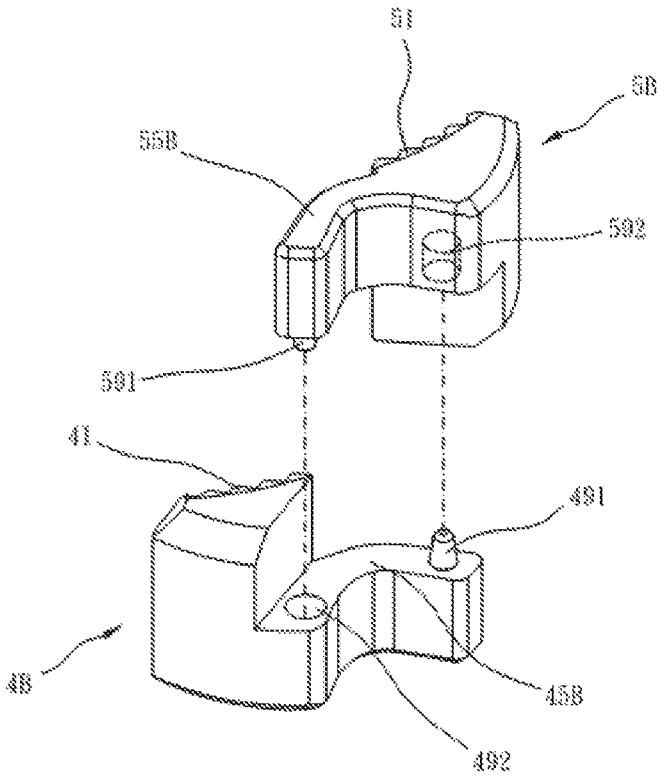
FIG. 11 is a partial enlarged view of a third preferred embodiment of the present invention.
Figure 12:
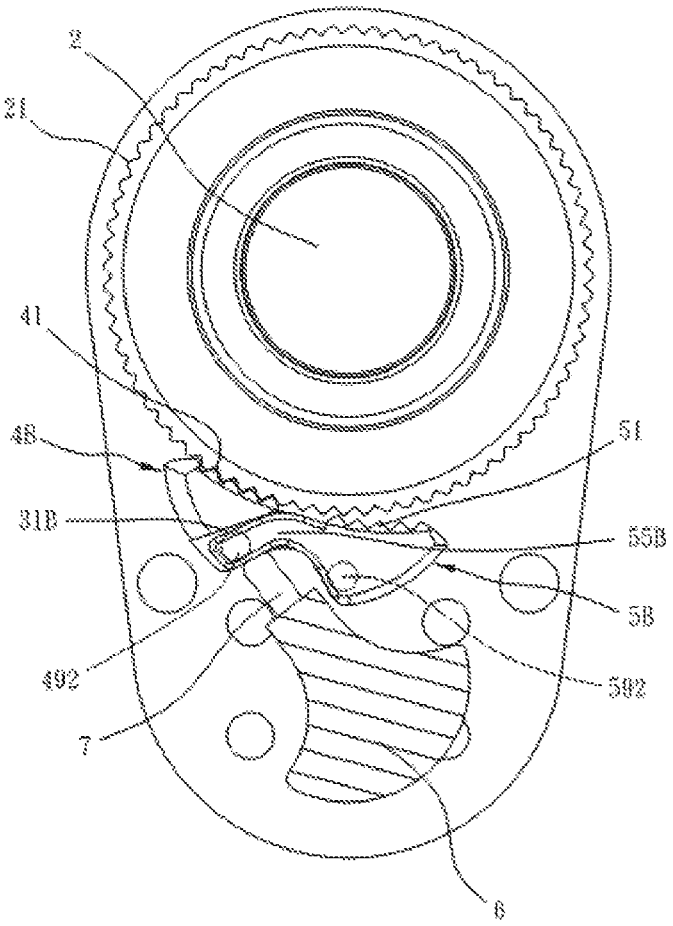
FIG. 12 and FIG. 13 are schematic views of the operation of a third preferred embodiment of the present invention.
Figure 13:
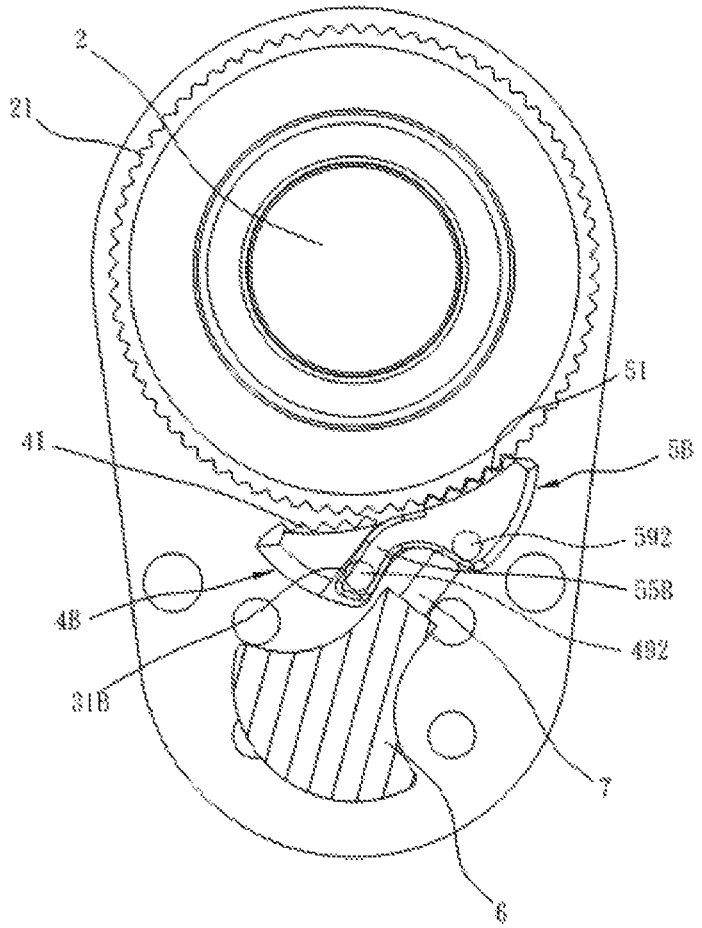

As shown in FIG. 8, in a second embodiment of the present invention, as compared with the above-described first embodiment, the sides of the elastic abutting assembly 7 towards which are oriented a first pin 45A of a first stopping member 4A and a second pin 55A of a second stopping member 5A may be extended with a first flange 48 and a second flange 58, wherein the end of the elastic abutting assembly 7 oriented towards the driving member 2 is sandwiched between said first and second flanges so that the elastic abutting assembly 7 can stably abut against the first pin 45A and second pin 55A in a limiting manner without becoming disengaged.

Further reference is made to FIGS. 9 to 13. In a third embodiment of the present invention, as compared with the above-described first embodiment, the side of a first pin 45B of a first stopping member 4B which is oriented towards the second pin 55B is provided with a first stud 491 and a first recess 492, and the side of a second pin 45B of a second stopping member 5B which is oriented towards the first pin 45B is provided with a second stud 591 and a second recess 592, wherein the first stud 491 and the second stud 591 are respectively inserted into the first recess 492 and the second recess 592. This similarly prevents the first stopping member 4B from detaching from the second stopping member 5B, and when the switching member 6 rotates, the first stopping member 4B and the second stopping member 5B can likewise move smoothly together.

Specifically, the first stud 491 and the second stud 591 are inclined, and the maximum radial dimensions of the first stud 491 and second stud 591 are smaller than the radial dimensions of the first recess 492 and the second recess 592. A gap 31B is formed between the first pin 45B and the second ratchet block 54, and another gap 31B is formed between the second pin 55B and the first ratchet block 44, said gaps 31 similarly allowing sufficient space between first stopping member 4B and the second stopping member 5B for them to slide and swing relative to each other. As a result, the present embodiment likewise can achieve the effect of having driving member 2 only engaging with either the first ratchet part 41 or the second ratchet part 51 at any one time, thus similarly allowing the driving member 2 to smoothly maintain one-way idling, while also avoiding jamming of the driving member 2 with the first ratchet part 41 or second ratchet part leading to the switching member 6 being unable to smoothly switch positions. The remaining structures are the same as in the first embodiment and thus no further description is given herein.

[Key to Reference Numerals]

1: Body
2: Driving member
3: Stopping assembly
4, 4A, 4B: First stopping member
5, 5A, 5B: Second stopping member
6: Switching member
7: Elastic abutting assembly
11: First chamber
12: Second chamber
21: Annular toothed part
31, 31B: Gaps
41: First ratchet part
42: First abutment part
43: First pressing part
44: First ratchet block
45, 45A, 45B: First pin
46: First groove
47: First bent end
48: First flange
491: First stud
492: First recess
51: Second ratchet part
52: Second abutment part
53: Second pressing part
54: Second ratchet block
55, 55A, 55B: Second pin
56: Second groove
57: Second bent arm
58: Second flange
591: Second stud -continued

| [Key to Reference Numerals] |
|---|
| 592: Second groove |
| 61: Hole |
| 71: Elastic member |
| 72: Abutting block |

Respective features of the illustrated embodiments may be combined in a many different combinations as required by particular circumstances or preferences so as to provide the functionality of a ratchet wrench and should not be construed as limited to the embodiments set forth herein; rather, the embodiments set forth herein are provided so that the disclosure will be thorough and complete, and will fully convey the scope of the invention to those skilled in the art. Those skilled in the art should now appreciate that various adaptations and modifications of the example and alternative embodiments described above can be configured without departing from the scope and spirit of the invention. Therefore, it is to be understood that, within the scope of the appended claims, the invention may be practiced other than as specifically described herein.

I claim:

1. A ratchet wrench comprising:

a body, provided with a first chamber and a second chamber communicating with the first chamber;

a driving member, rotatable disposed in the first chamber, and circumferentially provided with an annular toothed part along the outer peripheral surface;

a stopping member, comprising a first stopping member and a second stopping member which are disposed in the first chamber, are at least partially overlapped with each other, and can slide and swing relative to each other, wherein the first stopping member is provided with a first ratchet part, a side of the first stopping member opposite the first ratchet part is provided with a first abutment part and a first pressing part, the first abutment part is adjacent to the first ratchet part, and the first pressing part is away from the first ratchet part, and wherein the second stopping member is provided with a second ratchet part, a side of the second stopping member opposite the second ratchet part is provided with a second abutment part and a second pressing part, the second abutment part is adjacent to the second ratchet part and the second pressing part is away from the second ratchet part, and wherein the first stopping member comprises a first ratchet block and a first pin which are connected to each other, the first ratchet part being disposed on the first ratchet block, and the second stopping member comprises a second ratchet block and a second pin which are connected to each other, the second ratchet part being disposed on the second ratchet block, wherein the first abutment part and the first pressing part are disposed on the first pin, the second abutment part and the second pressing part are disposed on the second pin, the first pin and second pin overlap each other, the first abutment part corresponds to the second pressing part, and the first pressing part corresponds to the second abutment part;

a switching member, rotatably disposed in the second chamber, said switching member being provided with a hole in the radial direction, and being selectively rotated to a first position or a second position;

an elastic abutting assembly, one end of which is received in the hole of the switching member, while the other end abuts against the first stopping member and the second stopping member in a mutually limiting manner, and the first stopping member and the second stopping member abut in the direction of the annular toothed part, wherein, when the switching member is rotated to said first position, the elastic abutting assembly abuts against the first abutment part so that the first ratchet part abuts against the annular toothed part, and the elastic abutting assembly also abuts against the second pressing part of the second stopping member so as to cause the second ratchet part to move in a direction away from the annular toothed part and not become engaged therewith; and when the switching member is rotated to said second position, the elastic abutting assembly abuts against the second abutment part so that the second ratchet part abuts against the annular toothed part, and the elastic abutting assembly also abuts against the first pressing part of the first stopping member so as to cause the first ratchet part to move in a direction away from the annular toothed part and not become engaged therewith.

2. A ratchet wrench according to claim 1, wherein a gap is formed between the first pin and the second ratchet block, and another gap is formed between the second pin and the first ratchet block.

3. A ratchet wrench according to claim 2, wherein: the first ratchet block forms a first groove, the second ratchet block forms a second groove, the first groove and second groove are arcuate grooves, the ends of the first pin and the second pin respectively form a first bent end and a second bent end, the first bent end is accommodated in the second groove, the second bent end is accommodated in the first groove, and the shapes of the first bent end and the second bent end correspond to the shapes of the second groove and the first groove; the thickness of the first pin and second pin is equal to one half of the first ratchet block, and the thickness of the second ratchet block is the same as that of the first ratchet block; and the sides of the elastic abutting assembly towards which are oriented the first pin and the second pin may be extended with a first flange and a second flange, where the end of the elastic abutting assembly oriented towards the driving member is sandwiched between said first and second flanges.

4. A ratchet wrench according to claim 2, wherein: the thickness of the first pin and second pin is equal to one half of the first ratchet block, and the thickness of the second ratchet block is the same as that of the first ratchet block; the side of the first pin which is oriented towards the second pin is provided with a first stud and a first recess, and the side of the second pin which is oriented towards the first pin is provided with a second stud and a second recess, where the first stud and the second stud are respectively inserted into the first recess and the second recess; and the first stud and the second stud are inclined, and the maximum radial dimensions of the first stud and second stud are smaller than the radial dimensions of the first recess and the second recess.

5. A ratchet wrench according to claim 1, wherein the first ratchet block forms a first groove, the second ratchet block forms a second groove, the first groove and second groove are arcuate grooves, the ends of the first pin and the second pin respectively form a first bent end and a second bent end, the first bent end is accommodated in the second groove, the second bent end is accommodated in the first groove, and the shapes of the first bent end and the second bent end correspond to the shapes of the second groove and the first groove.

6. A ratchet wrench according to claim 1, wherein the thickness of the first pin and second pin is equal to one half of the first ratchet block, and the thickness of the second ratchet block is the same as that of the first ratchet block.

7. A ratchet wrench according to claim 1, wherein the sides of the elastic abutting assembly towards which are oriented the first pin and the second pin may be extended with a first flange and a second flange, wherein the end of the elastic abutting assembly oriented towards the driving member is sandwiched between said first and second flanges.

8. A ratchet wrench according to claim 1, wherein the side of the first pin which is oriented towards the second pin is provided with a first stud and a first recess, and the side of the second pin which is oriented towards the first pin is provided with a second stud and a second recess, wherein the first stud and the second stud are respectively inserted into the first recess and the second recess.

9. A ratchet wrench according to claim 8, wherein the first stud and the second stud are inclined, and the maximum radial dimensions of the first stud and second stud are smaller than the radial dimensions of the first recess and the second recess.

* * * * *